US007412810B2

(12) United States Patent
Konishi

(10) Patent No.: US 7,412,810 B2
(45) **Date of Patent: *Aug. 19, 2008**

(54) PACKAGING DEVICE FOR COVERING AND SEALING COVER FILM ONTO TRAY

(75) Inventor: Kazuo Konishi, Takatsuki (JP)

(73) Assignee: Ibaraki Seiki Machinery Company, Ltd., Osaka (JP)

( * ) Notice: Subject to any disclaimer, the term of this patent is extended or adjusted under 35 U.S.C. 154(b) by 136 days.

This patent is subject to a terminal disclaimer.

(21) Appl. No.: 11/301,956

(22) Filed: Dec. 13, 2005

(65) Prior Publication Data

US 2006/0123739 A1 Jun. 15, 2006

(30) Foreign Application Priority Data

Dec. 13, 2004 (JP) ..... 2004-359284

(51) Int. Cl.
*B65B 51/00* (2006.01)
*B65B 53/00* (2006.01)

(52) U.S. Cl. ..... 53/329.5; 53/329.4; 53/556; 53/373.5

(58) Field of Classification Search ..... 53/373.5, 53/373.7, 375.4, 375.6, 287, 329.3–4, 556, 53/329.5, 373.3, 7, 6
See application file for complete search history.

(56) References Cited

U.S. PATENT DOCUMENTS 3,637,760 A * 1/1972 Rostyslaw ..... 549/420
5,689,937 A * 11/1997 Gorlich et al. ..... 53/433
6,351,928 B2 * 3/2002 Torre ..... 53/556
6,488,972 B1 * 12/2002 Cerani ..... 426/110
6,834,476 B2 * 12/2004 Konishi ..... 53/329.5
6,835,440 B1 12/2004 Konishi et al.

* cited by examiner

*Primary Examiner*—Rinaldi I. Rada
*Assistant Examiner*—John Paradiso
(74) *Attorney, Agent, or Firm*—D. Peter Hochberg; Sean F. Mellino; Daniel J. Smola

(57) ABSTRACT

A packaging device is provided which prevents trays accommodating packaged items from being broken due to the tension in a film acting from above. The sealing base and the sealer perform a box motion by the combination of the back and forth movement of the general frame, and the upward and downward movement of the sealing base and the sealer, and the film is welded onto the flange of the tray while in movement. In this case, by setting the upper limit of the sealing base to the lower surface of the flange of the tray, it is possible for the deck plate to receive the tension of the film acting on the tray through the packaged item.

7 Claims, 10 Drawing Sheets

PACKAGING DEVICE FOR COVERING AND SEALING COVER FILM ONTO TRAY

BACKGROUND OF THE INVENTION

1. Field of the Invention

The present invention relates to a packaging device which stretches and covers a cover film onto a packaged item accommodated in a mounded fashion in a tray, and welds the film onto the flange section of the tray, in the conveyance path of the tray in a conveyor line.

2. Description of the Related Art

The invention disclosed in U.S. Pat. No. 6,834,476B presented by the same applicants as the present case is a packaging device for covering and sealing a cover film onto a tray, in which a sealing frame is moved back and forth reciprocally above the conveyance path of a band-shaped cover film, and a sealing base performs a box motion operation in conjunction with the reciprocal movement of the sealing frame, a tray together with a packaged item being pushed upwards by the upward movement in the box motion operation of the sealing base, the film thus being stretched by the upward pushing of the packaged item, and the film becoming sealed to the flange section of the tray by being pressed against the upper-positioned sealing frame. According to this device, the film is pushed and stretched from below by an upward impact from the packaged item, and the film can be welded to the flange section of the tray.

The chain conveyor conveys respective trays in which packaged items are mounded, at equidistant intervals, in a horizontal direction, and the sealing frame moves back and forth reciprocally above the trays in synchronism with the conveyance pitch of the trays. On the other hand, the sealing base performs a box motion operation in conjunction with the reciprocal movement of the sealing frame.

However, since this device causes the tray to press against an upper-positioned sealing frame, by means of a box motion operation of the lower sealing base only, the amount of vertical movement of the sealing base is large, and the bottom face of the tray becomes separated from the receiving plate which supports it. In this separated state, the tension in the film acts directly downwards on the tray, through the packaged item accommodated in a mounded fashion in the tray, and therefore, depending on the circumstances, the flange of the tray may break, or the flange may be bent backwards due to the load, thus presenting an obstacle to the welding between the flange and the cover film.

SUMMARY OF THE INVENTION

The present invention provides a device which resolves the aforementioned problems, that is a packaging device, comprising: a conveyance mechanism for causing respective trays to slide over the upper surface of a horizontal conveyance path by the pressing action of respective touch bars disposed at equidistant intervals on an endless chain; a mechanism for causing a deck plate disposed in an intermediate region between a preceding path region and a subsequent path region positioned on opposite sides of a cutaway region of the path, to move back and forth reciprocally in the direction of movement of the tray in unison with a general frame, and for successively transferring the trays from the preceding path region to the subsequent path region using the upper surface of the deck plate as a passage thereof; a mechanism for causing the general frame comprising a sealer provided in an upper region and a sealing base provided in a lower region, with the conveyance path therebetween, to move back and forth reciprocally; a mechanism for moving the sealing base upwards and downwards by means of the operation of a first lift mechanism, while moving reciprocally back and forth in unison with the general frame, sealing base having the same outline as the tray and being disposed about the perimeter of the deck plate; and a mechanism for moving a sealing frame set upwards and downwards by means of the operation of a second lift mechanism in unison with the sealer, the sealing frame set comprising a cutting blade surrounding the sealer having the same outline as the tray and a film pressing member, wherein during the movement of the general frame in the same direction as the tray, the first lift mechanism pushes the sealing base upwards until a position where the upper surface thereof makes contact with the lower surface of the flange of the tray mounted on the deck plate, and then lowers the sealing base to its original position in accordance with a withdrawing action of the general frame, and during the movement of the general frame in the same direction as the tray, the second lift mechanism pushes the sealing frame set downwards until a position where the sealing frame set makes contact with the upper surface of the flange of the tray supported on the sealing base, to weld a cover film onto the flange, and then lifts the sealing frame set to its original position in accordance with a withdrawing action of the general frame.

In this device, a sealer and a sealing frame positioned above and below the tray conveyance path perform a box motion, and cover film is welded by the sealer and the sealing frame onto a tray in which a packaged item is accommodated in a mounded fashion. In this, the first lift mechanism pushes the sealing base upwards until a position where the upper surface of the sealing base makes contact with the lower surface of the flange of a tray mounted on the deck plate, and the second lift mechanism pushes the sealer downwards until a position where it makes contact with the upper surface of the flange of the tray supported by the sealing base, thereby welding the cover film to the flange. Therefore, since the tension of the cover film that acts on the packaged item is received by the deck plate carrying the tray, then it is possible to prevent difficulties with sealing of the film due to bending of the flange of the tray as a result of the tension of the cover film, or problems such as breaking of the flange.

DESCRIPTION OF THE PREFERRED EMBODIMENTS

Embodiment 1

Figure 3:
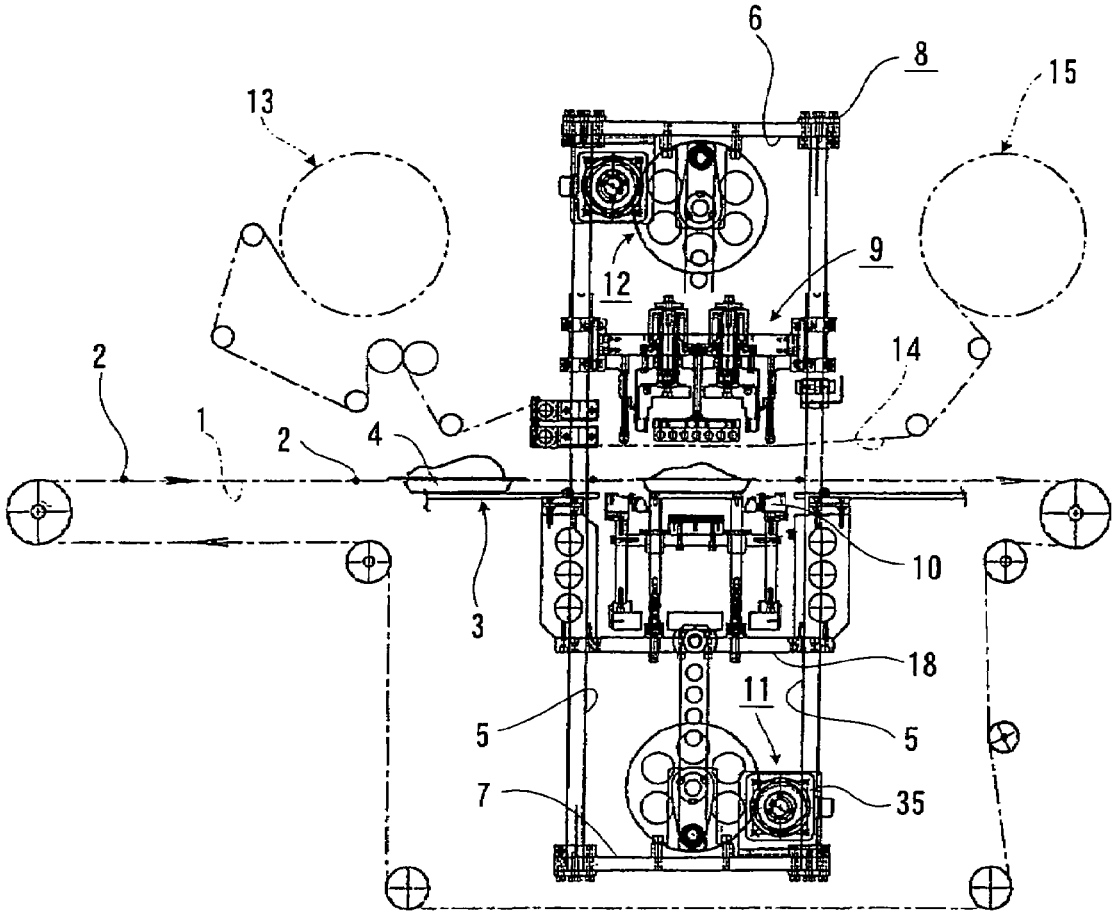
FIG. 3 is a general side view of the device according to the present invention.

FIG. 3 shows a general side view of the device, in which touch bars 2 disposed equidistantly on endless chains 1 cause trays 4 to advance at equidistant intervals in the direction of the arrow, along the upper surface of a horizontal conveyance path 3, by the rotational movement of the chains 1. A general frame 8 comprising four corner pillar members 5, a ceiling plate 6 provided on top of these pillar members 5, and a base plate 7 provided below the pillar members 5, is composed in such a manner that a sealing frame set 9 and a sealing base 10 are disposed respectively in upper and lower regions of the general frame 8, and the seal base 10 and the sealing frame set 9 are moved upwards and downwards by means of a first lift mechanism 11 and a second lift mechanism 12, respectively. A band-shaped cover film 14 wound and held on a first reel 13 moves at the same speed as the chains 1 through the lower region of the sealing frame set 9, and it is wound up onto a second reel 15.

Figure 1:
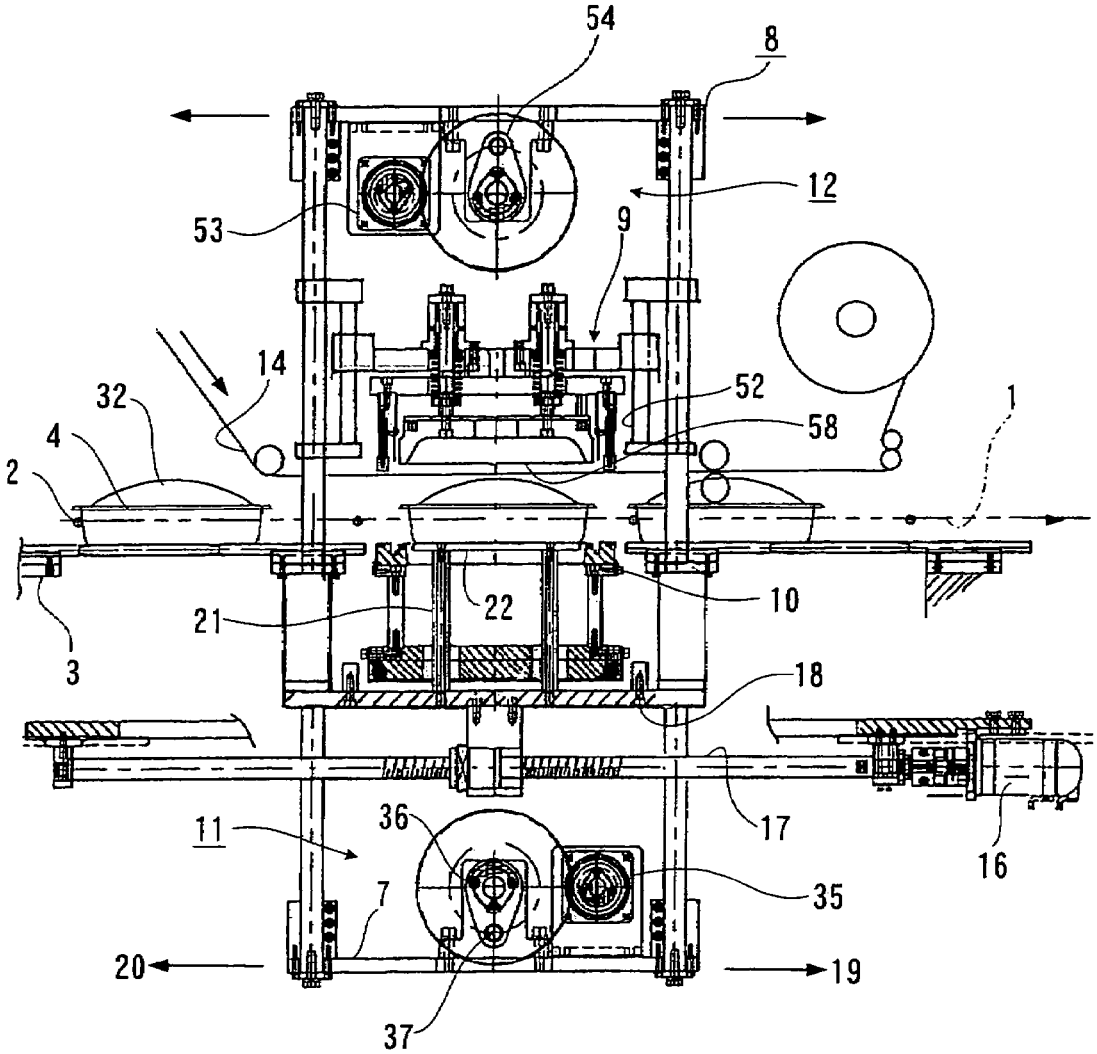
FIG. 1 is a side view of a general frame in the device according to the present invention.

FIG. 1 is a partial enlarged diagram of FIG. 3, in which the aforementioned general frame 8 travels back and forth reciprocally 19, 20, in concordance with the conveyance pitch of the trays 4, by means of forward and reverse rotation of a screw rod 17 which is operated by a motor 16. When the general frame 8 performs a reciprocal back and forth movement, the touch bars 2 cause the trays 4 to move successively onto the upper face of a deck plate 22 which is positioned on an intermediate plate 18, via leg members 21.

Figure 4:
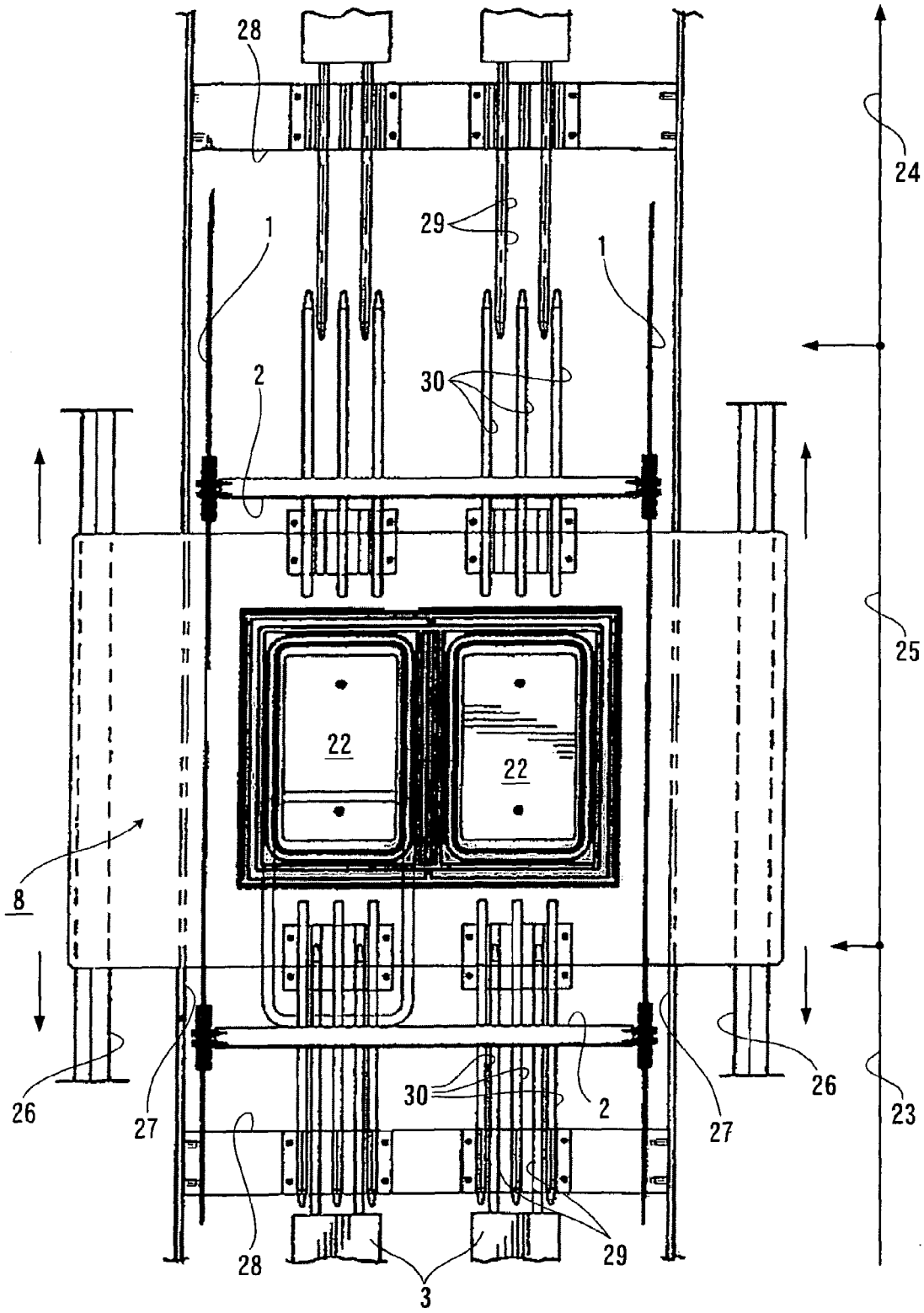
FIG. 4 is a plan view of a tray conveyance path.

FIG. 4 is a plan diagram of the horizontal conveyance path 3; the aforementioned touch bars 2 are spanned at equidistant intervals between the pair of endless chains 1, which are disposed on opposite sides of the path 3 and rotate along the path 3, and an intermediate region 25 is formed between the preceding path region 23 and the subsequent path region 24 in the conveyance path 3. The general frame 8, which is depicted in a plate shape in this diagram, moves back and forth reciprocally along rails 26 disposed on opposite sides in this cutaway region 25. In this case, the speed of advance of the side chains 1 and the speed of advance of the general frame 8 are the same.

Furthermore, in this diagram, a composition is achieved in which two fixed fingers 29 project toward the intermediate region 25 respectively, from front and rear stays 28 which are spanned between a pair of side plates 27 provided on opposite sides, and sets of three movable fingers 30 are disposed respectively facing these fixed fingers 29, these fingers 30 being caused to slide against the individual fingers 29 by the reciprocal movement of the general frame 8 and thus creating an expanding and contracting mechanism. The trays 10 are conveyed by using these fingers 29 and 30, and the deck plate 22 serving as a transfer area.

Figure 5:
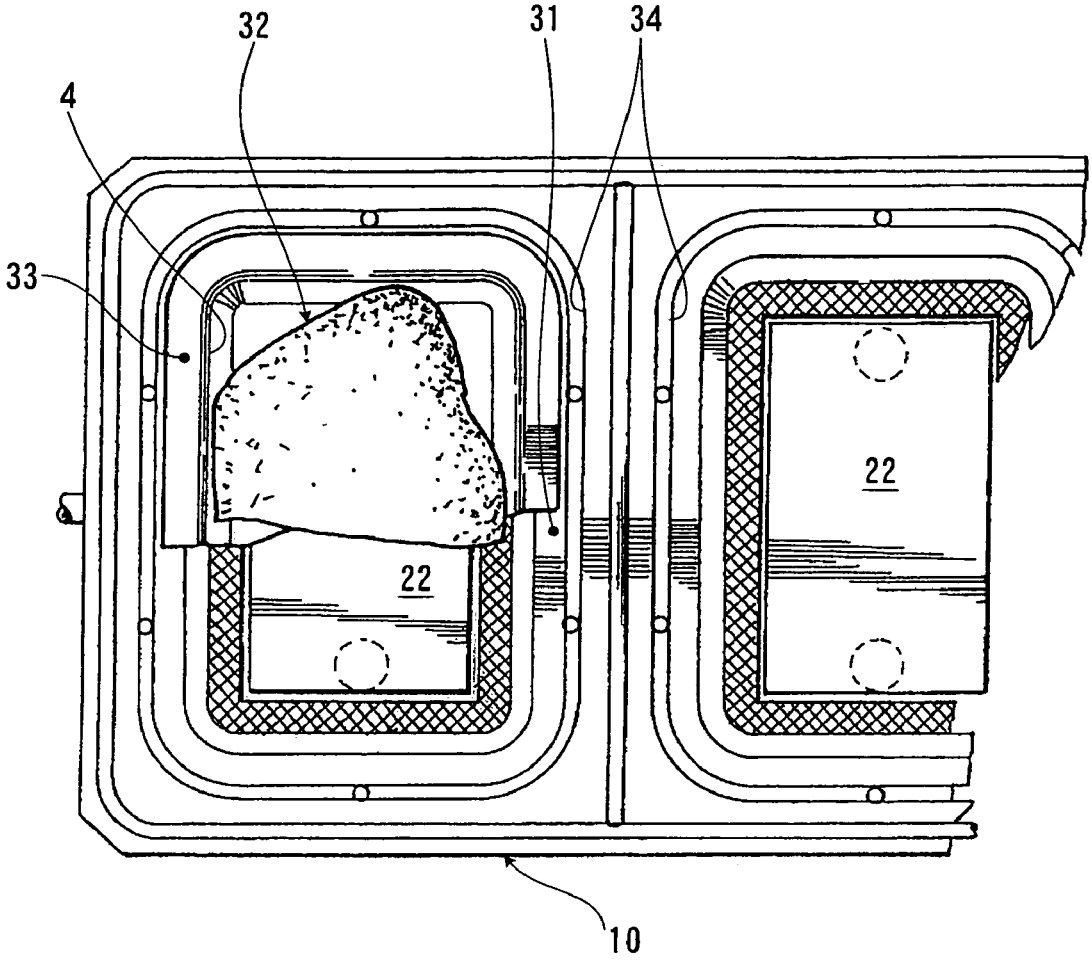
FIG. 5 is a partially cutaway plan view of a sealing base.

As shown in FIG. 1, a sealing base 10 having the same outline shape as the flange 33 formed on the perimeter edge of the tray 4 (see FIG. 5) is disposed about the periphery of the deck plate 22. FIG. 5 shows a plan view of this sealing base 10, in which a tray 4 bearing a packaged item 32 has a continuous flange 33 on the perimeter of the upper side open section thereof. The sealing base 10 which surrounds the deck plate 22 holds the flange 33 of the tray on a supporting face 31 thereof, and it is also formed with an endless cutting blade insertion groove 34 following the outline of the flange 33.

Figure 2:
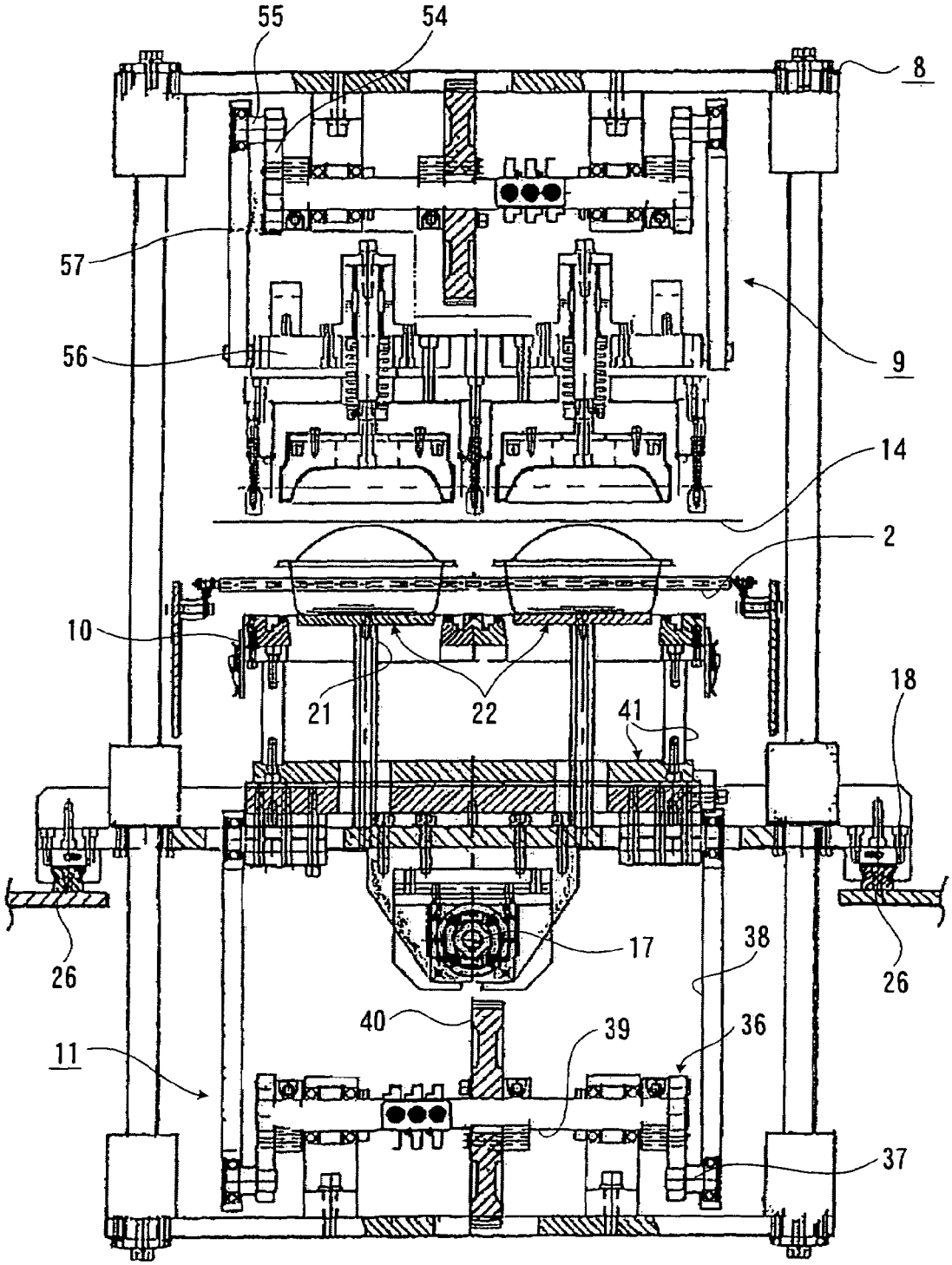
FIG. 2 is a front view of FIG. 1.

In FIG. 1, a first lift mechanism 11 which moves the sealing base 10 upwards and downwards is constituted by a first servo motor 35 and a crank arm 36 which is caused to rotate by the motor 35. As shown in FIG. 2, a crank pin 37 in the crank arm 36 is connected to the supporting frame 41 of the sealing base 10, by means of a coupling bar 38. The crank arm 36 is caused to rotate by means of the motive force of the first servo motor 35 being applied to a gear wheel 40 fixed to a main shaft 39.

Figure 6:
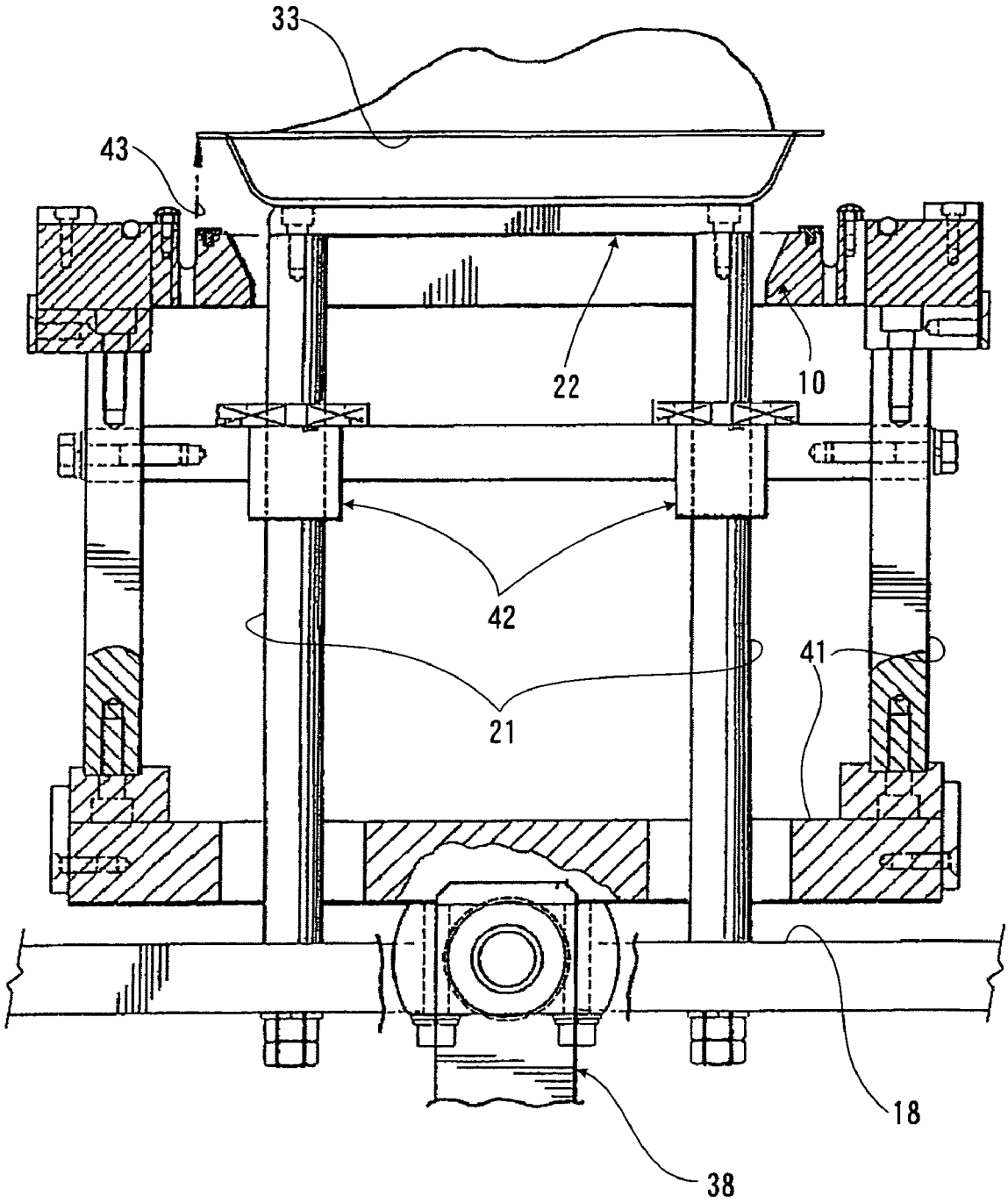
FIG. 6 is an enlarged side view of a sealing base.
Figure 7:
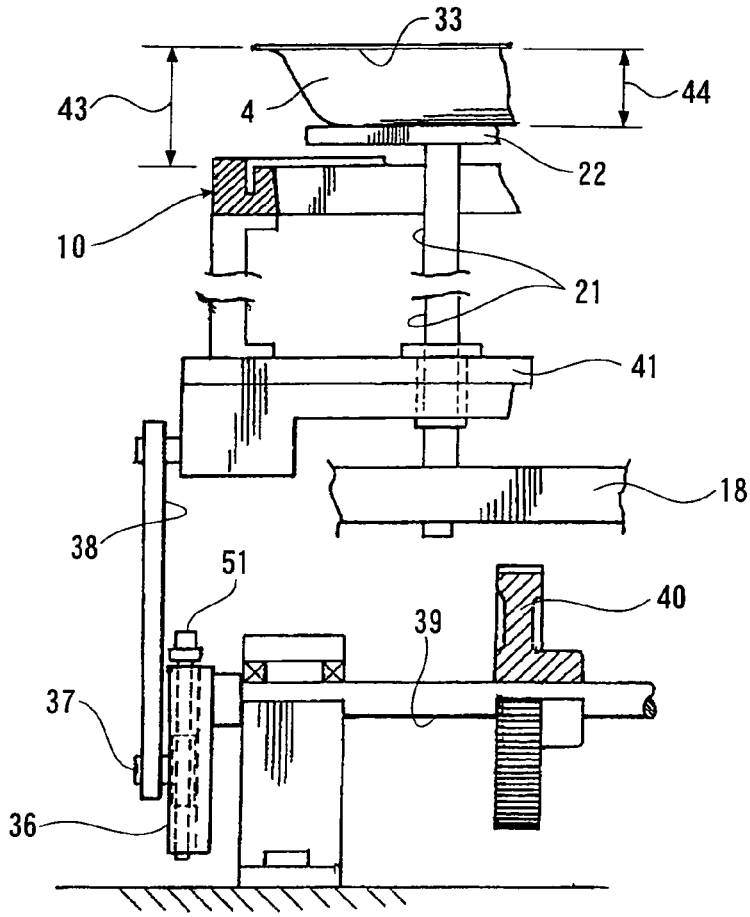
FIG. 7 is an illustrative diagram of the action of a sealing base and a lift mechanism.

The sealing base 10 and the frame-shaped supporting frame 41 shown in enlarged form in FIG. 6 move upwards and downwards in an integral manner with sleeves 42 which slide along leg members 21 erected in a standing fashion on the intermediate plate 18. In this case, the amount of lift 43 of the sealing base 10 is limited at the point where the upper face of the sealing base 10 makes contact with the lower face of the flange 33 of the tray 4, as shown in FIG. 7. If the height 44 of the tray 4 used is changed, then the amount of lift 43 must also be changed. Supposing that the amount of lift 43 is taken to be uniform and unchangeable, then if the height 44 of the tray is reduced, the tray 4 will float up above the deck plate 22 when it is lifted up by the sealing base 10. On the other hand, if the height 44 of the tray 4 is increased, then the sealing base 10 will not reach the position of the flange 33. As a means of resolving these problems, the rotational diameter of the crank pin 37 is adjusted, as described below.

Figure 8:
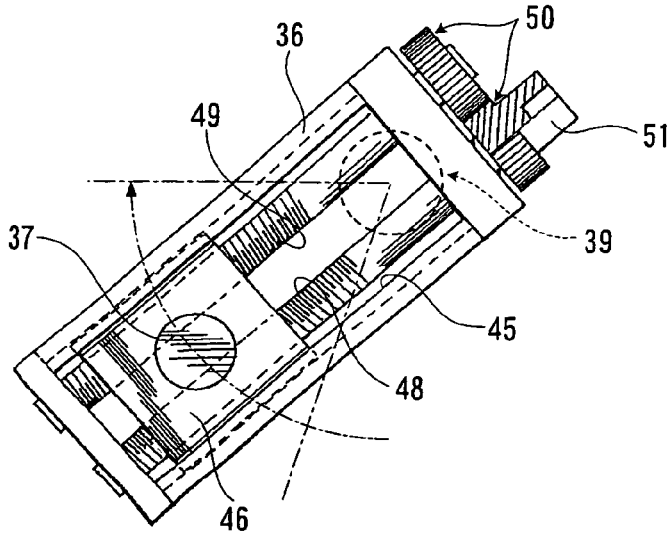
FIG. 8 is a front view of a crank arm.

More specifically, as shown in FIG. 8, guides 45 are formed on both sides of the inner part of the crank arm 36, and a supporting base body 46 of the crank pin 37 is supported slidably by these guides 45. Two screw bars 48 and 49 which are coupled by the intermeshing of two gear wheels 50, are disposed on the crank arm 36, and these screw bars 48 and 49 engage in a screwing action with a female screw threaded on the inner surface of the supporting base body 46. By rotating the screw bars 48 and 49 by operating a handle 51, it is possible to change the gap between the main shaft 39, indicated by the broken line, and the crank pin 37. By means of this mechanism, the lower limit position of the sealing base 10 in FIG. 7 can be changed, and hence the amount of lift 43 of the sealing base 10 can be adjusted in accordance with the height 44 of the tray.

On the other hand, the sealing frame set 9 provided on the general frame 8 in FIG. 1 moves upwards and downwards along guides 52 by means of the second lift mechanism 12, and the second lift mechanism 12 is constituted by a second servo motor 53 and a crank arm 54 which is caused to rotate by this motor 53. A crank pin 55 in the crank arm 54 in FIG. 2 is connected to a supporting frame 56 of the sealing frame set 9, by means of a coupling bar 57, and the sealing frame set 9 can be pushed downwards in concordance with the forward motion of the general frame 8.

The first servo motor 35 is provided as a source of rotational force for the crank arm 36 of the first lift mechanism 11 in FIG. 1, and the second servo motor 53 is provided as a source of rotational force for the crank arm 54 of the second lift mechanism 12, in such a manner that the mutual speed of the crank arms 36 and 54 can be changed, or their movement can be halted, by synchronizing the operations of the two servo motors.

Figure 9:
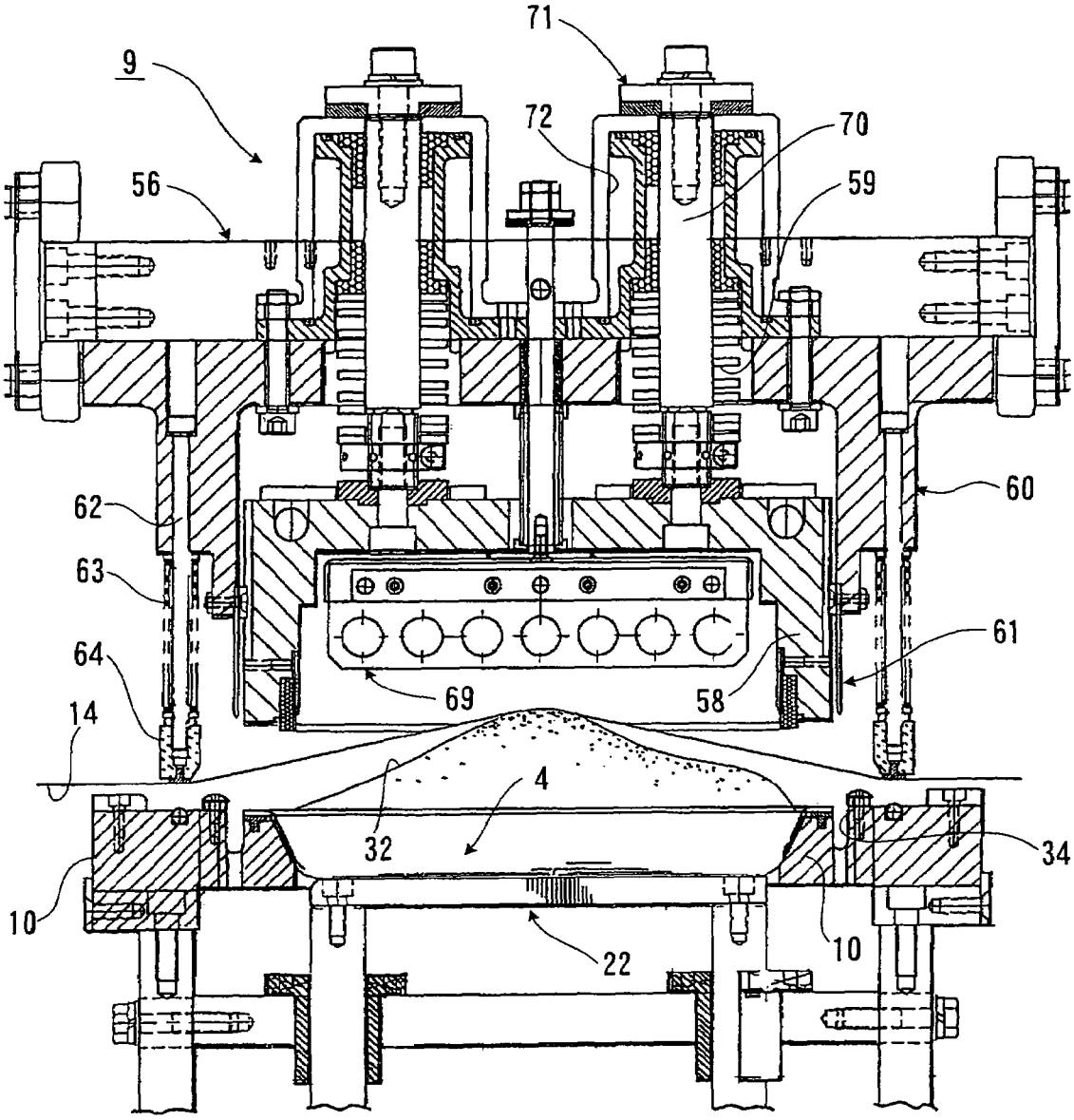
FIG. 9 is an illustrative diagram of the action of a sealing base and a sealing frame set.

As shown in enlarged view in FIG. 9, in the sealing frame set 9, an inverted trough-shaped sealer 58 having the same outline shape as the tray 4 is supported on a support frame 56 via springs 59. An endless cutting blade 61 for cutting away the cover film 14 by penetrating into the lower-positioned insertion groove 34 described previously is fixed onto a fixing plate 60 which surrounds the sealer 58, on the lower side of the frame 56. Furthermore, coil springs 63 are wound respectively about a plurality of vertically slidable bar members 62, which surround the cutting blade 61, and furthermore, flexible, continuous or non-continuous film pressing members 64 which surround the perimeter of the tray 4 are disposed on the lower ends of the bar members 62.

In FIG. 9, when the packaged item 32 is lifted up together with the tray 4, by the lifting of the sealing base 10, the film pressing members 64 press the film 14 down onto the upper surface of the sealing base 10, by the elastic force of the coil springs 63. On the other hand, urethane rubber 69 disposed inside the sealer 58 expels the air inside the film 14 by pressing the film 14 against the packaged item 32. In this case, the tension in the cover film 14 and the pressing force of the urethane rubber 69 act as a load on the flange 33 of the tray 4, through the packaged item 32, but since the tray 4 is supported from below by the deck plate 22, breaking or bending back of the flange 33 is prevented and perfect welding of the cover film 14 onto the flange 33 of the tray 4 can be achieved. Subsequently, the sealer 58 pushes the film 14 against the sealing base 10 by means of the elastic force of the main springs 59, and the cover film 14 welds onto the upper surface of the flange on the tray 4. The cutting blade 61 is then inserted into the insertion groove 34, and the film 14 is cut about the perimeter of the tray 4, in accordance with the outline of the flange provided on the tray 4.

Stoppers 71 on the upper ends of core bars 70 provided in a standing fashion on the upper face of the sealer 58 receive the tension of the main springs 59 on the upper face of cylinders 72, thereby holding the main springs 59 in an appropriate state of compression, and welding the cover film 14 onto the tray 4 by means of the sealing frame 10 and the sealer 58.

Figure 10:
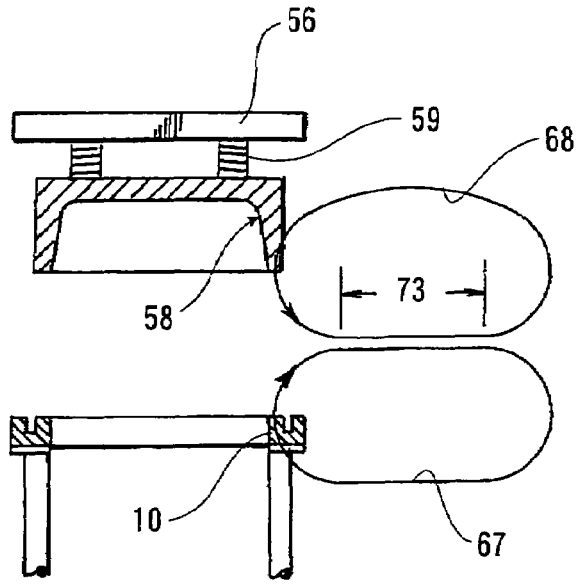
FIG. 10 is a diagram of a box motion performed by the sealing base and sealing frame set.

In FIG. 1, a sealing base 10 in a lower region and a sealer 58 in an upper region approach each other mutually during the course of movement in the direction of arrow 19 of a reciprocally moving general frame 8. Thereupon, when the general frame 8 is withdrawn in the direction of the arrow 20, the sealing base 10 and the upper-positioned sealing frame set 9 are separated from each other, and this movement of the respective elements is shown in FIG. 10; since the crank arm 54 which lowers the sealer 58 rotates in one direction by the second servo motor 53, the sealer 58 moves along a virtually elliptical box motion path 68 as shown in FIG. 10. However, in this case, since the sealer 58 abuts against the sealing base 10 as it rises upwards from below in the region 73 indicated, and since the main springs 59 provided between the sealer 58 and the supporting frame 56 are compressed, then the downward movement is halted in this region 73, whereby both the sealing base 10 and the sealer 58 move linearly through the region 73, and the cover film is welded onto the flange of the tray by the sealing base 10 and the sealer 58.

Figure 11:
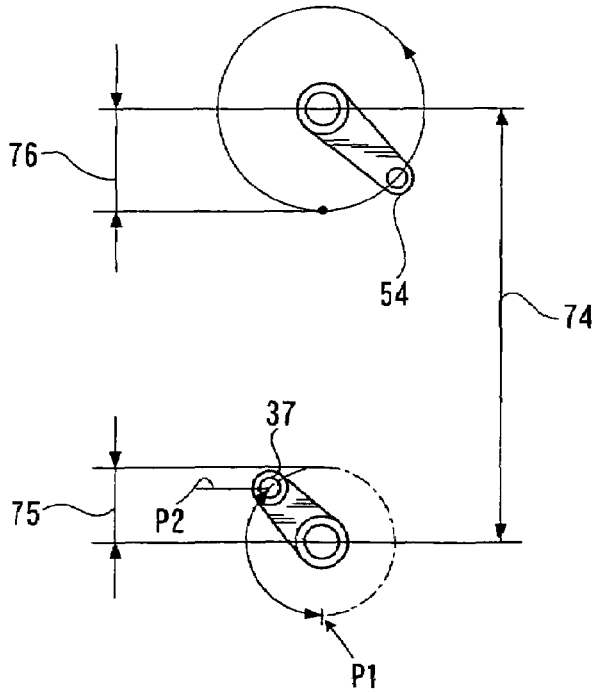
FIG. 11 is an illustrative diagram of a crank arm.

The fact of adjusting the rotational diameter of the crank pin 37 in accordance with the height 44 of the tray 4 was previously described with respect to FIG. 7 and FIG. 8, and the rotational diameter can be adjusted by adopting the composition shown in the drawings to the crank pin 55 of the second lift mechanism 12 in FIG. 2. In other words, since the main shaft gap 74 between the upper and lower crank arms in FIG. 11 is unchangeable, then if the rotational diameter 75 of the lower crank pin is adjusted in accordance with the height of the tray, it becomes necessary to adjust the rotational diameter 76 of the upper side crank pin in inverse proportion to the adjustment of the lower crank pin. In this case, the upper crank arm 54 rotates completely through 360°, but the lower crank arm 36 rotates forwards and rearwards between the top dead center point P1 and a point P2 which does not reach the top dead center.

Embodiment 2

Figure 12:
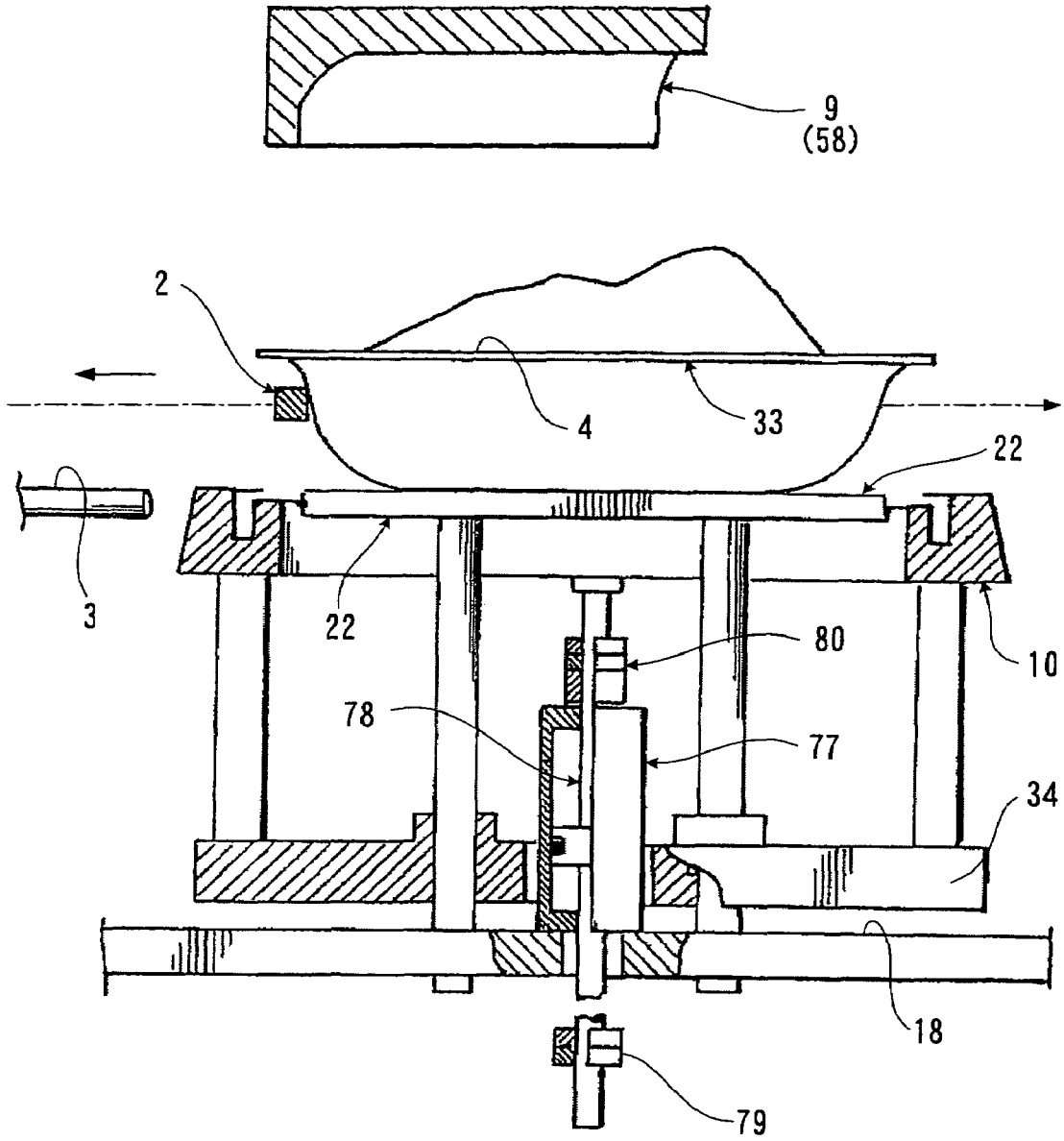
FIG. 12 is a diagram of an embodiment of a lift mechanism.

FIG. 12 shows an embodiment in which the lower-positioned sealing base 10 and the upper-position sealing frame set 9 have different lifting mechanisms, and taking the lower-positioned sealing base 10 as an example, the lift mechanism is formed by a fluid cylinder 77 fixed to the intermediate plate 18. In order that the upper limit of the lifting movement of the sealing base 10 is always restricted by the lower face portion of the flange 33 on the tray 4 which is mounted on the deck plate 22 in accordance with the height of the tray 4, a stopper 79 is provided on the lower side of the piston rod 78, in a position which can be changed along the rod 78, and a variable stopper 80 is also provided on the rod 78 in the upper portion of the cylinder. Furthermore, this composition may also be adopted for the upper-positioned sealing frame set 9.

What has been described above are preferred aspects of the present invention. It is of course not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, combinations, modifications, and variations that fall within the spirit and scope of the appended claims.

What is claimed is:

1. A packaging device for packaging a plurality of trays, each tray having a flange having an upper surface and a lower surface, comprising:

an endless chain having touch bars disposed at equidistant intervals;

a conveyance mechanism for causing respective trays to slide over the upper surface of a horizontal conveyance path having an upper surface, by the pressing action of said respective touch bars disposed at equidistant intervals on said endless chain;

a deck plate having an upper surface disposed in an intermediate region between a preceding path region and a subsequent path region positioned on opposite sides across a cutaway region of the path;

a general frame having an upper region and a lower region and comprising a sealer and a sealing frame set in said upper region and a sealing base in said lower region;

a mechanism for causing said deck plate disposed in an intermediate region between a preceding path region and a subsequent path region positioned on opposite sides across a cutaway region of the path to move back and forth reciprocally in the direction of movement of the tray in unison with said general frame, and for successively transferring the trays from the preceding path region to the subsequent path region using the upper surface of the deck plate as a passage;

a mechanism for causing the general frame comprising said sealer provided in said upper region and said sealing base provided in a lower region, with the conveyance path between said upper region and said lower region, to move back and forth reciprocally;

a first lift mechanism for moving said sealing base upwards and downwards and a second lift mechanism for moving said sealing frame set upwards and downwards;

a mechanism for moving the sealing base upwards and downwards by the operation of said first lift mechanism, while moving reciprocally back and forth in unison with the general frame, the sealing base having the same outline as the tray and being disposed about the perimeter of the deck plate; and a mechanism for moving said sealing frame set upwards and downwards by the operation of said second lift mechanism in unison with the sealer, the sealing frame set comprising a cutting blade surrounding the sealer having the same outline as the tray and a film pressing member, wherein during the movement of the general frame in the same direction as the tray, the first lift mechanism pushes the sealing base upwards until a position where the upper surface of said sealing base makes contact with the lower surface of the flange of the tray mounted on the deck plate, and then lowers the sealing base to the original position in accordance with a withdrawing action of the general frame; and during the movement of the general frame in the same direction as the tray, the second lift mechanism pushes the sealing frame set downwards until a position where the sealing frame set makes contact with the upper surface of the flange of the tray supported on the sealing base, to weld a cover film onto the flange, and then lifts the sealing frame set to its original position in accordance with a withdrawing action of the general frame, and wherein the first lift mechanism for moving the sealing base upwards and downwards comprises a coupling bar, a fluid cylinder and a crank arm having a crank pin, said crank arm transmitting the rotational movement of said crank pin to the sealing base by said coupling bar, and wherein the crank arm comprises a mechanism for adjusting the rotational diameter of the crank pin, in accordance with the height of the tray mounted on the deck plate.

2. The packaging device according to claim 1, wherein the second lift mechanism comprises a crank arm having a crank pin, and wherein the rotational diameter of said crank pin of said crank arm forming the second lift mechanism is adjustable in proportion to the adjustment in the rotational diameter of the crank pin of the crank arm forming the first lift mechanism in accordance with the height of the tray mounted on the deck plate.

3. The packaging device according to claim 2, wherein a first servo motor is provided as a rotational drive source for the crank arm of the first lift mechanism, and a second servo motor is provided as a rotational drive source for the crank arm of the second lift mechanism, and the mutual speed of the two crank arms is changed or the movement of the crank arms is halted, by synchronizing the operation of the two servo motors.

4. The packaging device according to claim 1, wherein the second lift mechanism further comprises a fluid cylinder having a piston and wherein the amount of piston stroke movement in said fluid cylinder forming the second lift mechanism can be adjusted in proportion to the adjustment of the rotational diameter of the crank pin of the crank arm forming the first lift mechanism in accordance with the height of the tray mounted on the deck plate.

5. The packaging device according to claim 1, wherein the first lift mechanism for moving the sealing base upwards and downwards comprises a fluid cylinder for transmitting the linear movement of the piston to the sealing base, and the cylinder comprises a movable mechanism for adjusting the amount of stroke movement of the piston in accordance with the height of the tray mounted on the deck plate.

6. The packaging device according to claim 5, wherein the rotational diameter of said crank pin of said crank arm forming the second lift mechanism can be adjusted in proportion to the adjustment in the amount of piston stroke movement in the fluid cylinder forming the first lift mechanism in accordance with the height of the tray mounted on the deck plate.

7. The packaging device according to claim 1, wherein the amount of piston stroke movement in said fluid cylinder forming the second lift mechanism can be adjusted in proportion to the adjustment in the amount of piston stroke movement in the fluid cylinder forming the first lift mechanism in accordance with the height of the tray mounted on the deck plate.

* * * * *